US006783467B2

(12) United States Patent
Sasaki

(10) Patent No.: US 6,783,467 B2
(45) **Date of Patent: *Aug. 31, 2004**

(54) THREAD-WOUND GOLF BALL

(75) Inventor: Takashi Sasaki, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/453,501

(22) Filed: Jun. 4, 2003

(65) Prior Publication Data

US 2003/0232664 A1 Dec. 18, 2003

(30) Foreign Application Priority Data

Jun. 6, 2002 (JP) ..... 2002-165316

(51) Int. Cl.[7] ..... A63B 37/06
(52) U.S. Cl. ..... 473/357
(58) Field of Search ..... 473/356–366

(56) References Cited

U.S. PATENT DOCUMENTS 5,810,677 A * 9/1998 Maruko et al. ..... 473/357
5,848,942 A 12/1998 Kato
5,853,337 A 12/1998 Moriyama et al.
5,993,968 A * 11/1999 Umezawa et al. ..... 428/407
6,054,550 A * 4/2000 Umezawa et al. ..... 528/76
6,083,120 A * 7/2000 Umezawa et al. ..... 473/356
6,196,937 B1 * 3/2001 Kuttappa ..... 473/351
6,319,151 B1 * 11/2001 Sugimoto ..... 473/357
6,582,324 B2 * 6/2003 Moriyama et al. ..... 473/356

FOREIGN PATENT DOCUMENTS

JP 9-294830 A 11/1997
JP 10-201881 A 8/1998

* cited by examiner

*Primary Examiner*—Raeann Gorden
(74) *Attorney, Agent, or Firm*—Birch, Stewart, Kolasch & Birch, LLP

(57) ABSTRACT

In a thread-wound golf ball having a cover wrapped around a rubber thread layer formed by winding a rubber thread around a center, the volume ratio of the rubber thread layer to the thread-wound golf ball is 10–20%. When deformation formed by applying an initial load of 98N to a final load of 1274N to the center is A, and deformation formed by applying an initial load of 98N to a final load of 1274N to a thread-wound core having a rubber thread wound around the center is B, the difference therebetween (A–B) is 0.5–0.7 mm. The cover includes thermoplastic polyurethane based elastomer as the main material. The shore D hardness of the cover is 40–55.

9 Claims, 1 Drawing Sheet

THREAD-WOUND GOLF BALL

BACKGROUND OF THE INVENTION

1. Field of the Invention

The present invention relates to a thread-wound golf ball of a multilayer structure having a rubber thread layer wrapped around the center, exhibiting favorable approach spin performance and shot feeling, great flight distance, and superior in scuff resistance.

2. Description of the Background Art

A thread-wound golf ball has a structure in which a rubber thread layer formed by winding a tensioned rubber thread around a solid center or a liquid center is surrounded entirely with a cover. The thread-wound golf ball generally having the favorable shot feeling and superior approach spin performance is disadvantageous in that the spin rate is too high and the launch angle is small. Therefore, there was a problem that the flight distance cannot be easily increased. Thus, amateur golf players generally have a tendency for using a solid golf ball exhibiting long flight distance than such a thread-wound golf ball.

Several approaches have been made to increase the flight distance of a conventional thread-wound golf ball with a solid center. For example, U.S. Pat. No. 5,848,942 discloses the definition of the center diameter to 30–38 mm, and the center hardness distribution, the cover flexural modulus and the like to a predetermined range. U.S. Pat. No. 5,853,337 discloses the approach of using a cover of high hardness as well as defining the center diameter to 30–38 mm and defining the difference between the load deformation of the center and the load deformation of the ball. Japanese Patent Laying-Open No. 10-201881 discloses the definition of the load deformation of the center, the cover hardness, and the flexural modulus to a predetermined range with the center diameter set to 30–38 mm.

Japanese Patent Laying-Open No. 9-294830 discloses a thread-wound golf ball with a non-yellowing thermoplastic polyurethane elastomer as the main component for the cover, wherein the specific gravity difference between the center and cover is not more than 0.2.

However, a thread-wound golf ball exhibiting sufficient great flight distance while maintaining a superior approach spin performance and shot feeling is not yet available even by the techniques disclosed in U.S. Pat. No. 5,848,942, U.S. Pat. No. 5,853,337 and Japanese Patent Laying-Open No. 10-201881. It is to be noted that ionomer resin is used as the main material for the cover of such thread-wound golf balls. Therefore, the shot feeling was hard. Also, the surface of the cover is easily scratched when hit with a short iron. The surface of golf ball is napped or scuffed, exhibiting poor scuff resistance.

The thread-wound golf ball of Japanese Patent Laying-Open No. 9-294830 employing thermoplastic polyurethane elastomer for the cover material could not achieve both favorable approach spin performance and great flight distance since the volume ratio of the rubber thread layer was not taken into account.

SUMMARY OF THE INVENTION

In view of the foregoing, an object of the present invention is to provide a thread-wound golf ball exhibiting favorable approach spin performance and shot feeling with a flight distance equal to or greater than the flight distance by a solid golf ball, and superior scuff resistance.

The inventors endeavored to achieve the above object. The inventors found that a thread-wound golf ball exhibiting a flight distance greater than that of a solid golf ball while maintaining favorable approach spin performance and shot feeling can be obtained by optimizing the balance between the volume ratio of the rubber thread layer to the thread-wound golf ball and the tension of the rubber thread wound around the center. The inventors also found that the scuff resistance can be improved by employing a cover with thermoplastic polyurethane based elastomer as the main material.

The thread-wound golf ball of the present invention has a cover wrapped around a rubber thread layer formed by winding a rubber thread around the center. The ratio of the volume of the rubber thread layer to the volume of the entire thread-wound golf ball is 10–20%. When deformation formed by applying an initial load of 98N to a final load of 1274N to the center is A, and deformation formed by applying an initial load of 98N to a final load of 1274N to a thread-wound core having a rubber thread wound around the center is B, the difference in deformation (A–B) is 0.5–0.7 mm. The cover includes thermoplastic polyurethane based elastomer as the main material. The shore D hardness of the cover is 40–55.

In the thread-wound golf ball of the present invention, it is preferable that the thickness of the cover is 0.8–1.8 mm, deformation A formed by applying an initial load of 98N to a final load of 1274N to the center is 3.3–3.9 mm, and deformation B formed by applying an initial load of 98N to a final load of 1274N to the thread-wound core is 2.7–3.4 mm.

In the thread-wound golf ball of the present invention, the di-isocyanate constituting the thermoplastic polyurethane based elastomer included as the main material in the cover is preferably alicyclic di-isocyanate.

The foregoing and other objects, features, aspects and advantages of the present invention will become more apparent from the following detailed description of the present invention when taken in conjunction with the accompanying drawing.

DESCRIPTION OF THE PREFERRED EMBODIMENT

Figure 1:
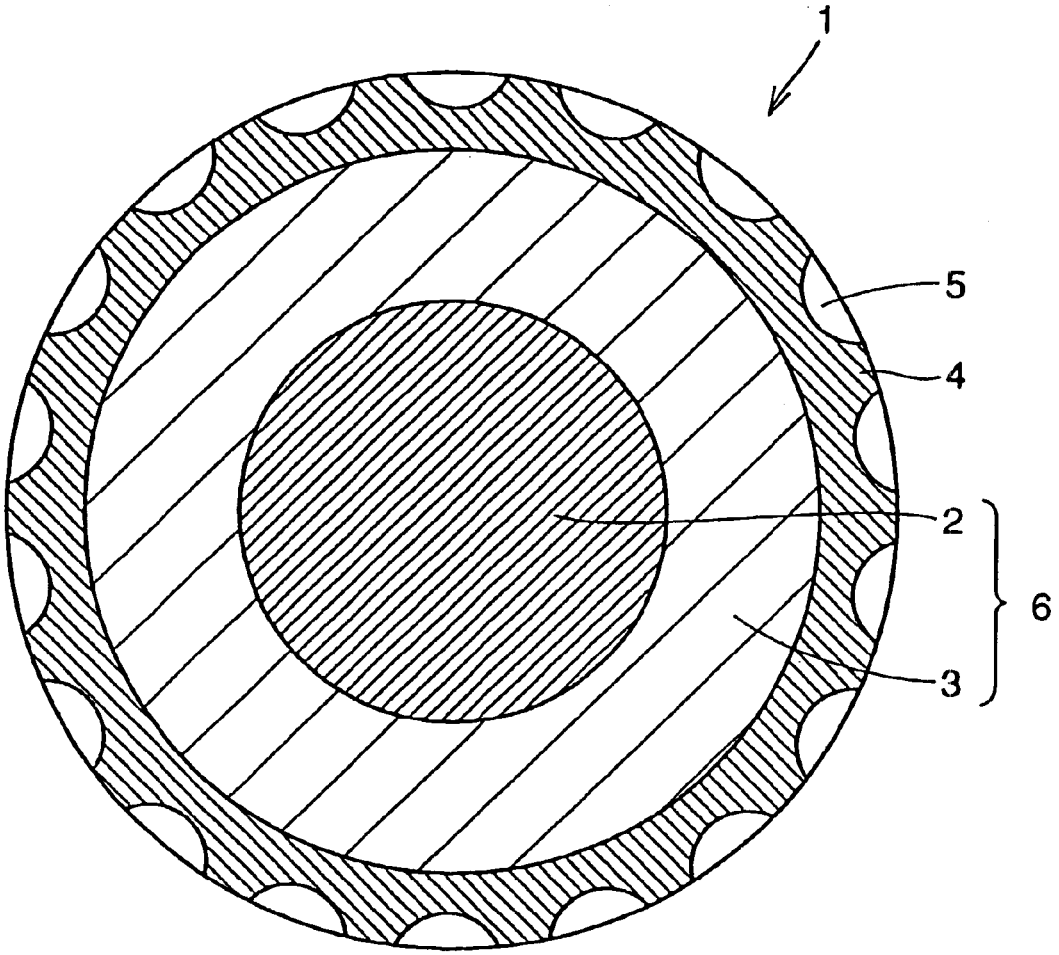
FIG. 1 is a schematic sectional view of an example of a thread-wound golf ball of the present invention.

Referring to FIG. 1, a thread-wound golf ball 1 includes a spheric center 2, a rubber thread layer 3 formed by winding a rubber thread around center 2, and a cover 4 surrounding rubber thread layer 3. Center 2 and rubber thread layer 3 constitute a thread-wound core 6. Dimples 5 are formed at cover 4.

Thread-wound golf ball 1 of the present invention is characterized in that the volume ratio of rubber thread layer 3 to the entire thread-wound golf ball 1 is set to 10–20%, and the difference in deformation (A–B) is set to 0.5–0.7 mm, where A is deformation formed by applying an initial load of 98N to a final load of 1274N to center 2 and B is deformation formed by applying an initial load of 98N to a final load of 1274N to thread-wound core 6.

By setting the volume ratio of rubber thread layer 3 to the above cited range, the spin rate when thread-wound golf ball 1 is hit with a club of high head speed can be reduced, and the approach spin performance when hit with a short iron can be maintained. If the volume ratio of rubber thread layer 3 is less than 10%, the amount of rubber thread layer 3 is so small that the approach spin performance when hit with a short iron cannot be maintained. If this ratio is greater than 20%, the amount of rubber thread layer 3 is so great that the flight distance cannot be increased since the spin rate when hit with a club of high head speed will be higher. The volume ratio of rubber thread layer 3 is preferably 12.0–19.5%, more preferably 12.0–15.0%. The volume of rubber thread layer 3 is defined as the volume of the region between the outer surface of center 2 and the boundary between rubber thread layer 3 and cover 4. In the case where cover 4 penetrates through rubber thread layer 3, the boundary between rubber thread layer 3 and cover 4 implies the phantom line connecting the outermost surface of rubber thread layer 3.

By optimizing the resilience of thread-wound golf ball 1 with the difference (A–B) between load deformation A of center 2 representing the tension of the rubber thread wound around center 2 and load deformation B of thread-wound core 6 set to 0.5–0.7 mm, favorable shot feeling and long flight distance can be achieved. If the deformation difference (A–B) is below 0.5 mm, the tension of the rubber thread wound around center 2 is so low that the resilience performance of thread-wound golf ball 1 will be degraded. Accordingly, a great flight distance cannot be achieved. If this difference is greater than 0.7 mm, the tension of the rubber thread wound around center 2 is so high that too much load will be applied on the rubber thread. Accordingly, the durability of golf ball 1 will be degraded.

As the rubber thread used to form rubber thread layer 3, a rubber composition conventionally employed can be used. For example, a rubber thread obtained by vulcanizing a rubber composition or the like having natural rubber or a blend of natural rubber and polyisoprene mixed with sulfur, a vulcanization auxiliary agent, a vulcanization accelerator, an antioxidant or the like can be used. The thickness of rubber thread layer 3 is preferably set to 0.8–1.9 mm, particularly preferably to 1.0–1.7 mm from the standpoint of productivity, resilience performance, control performance, and shot feeling.

The diameter of thread-wound golf ball 1 of the present invention is preferably set to 42.67–42.93 mm, more preferably to 42.67–42.82 mm. Also, deformation C formed by applying an initial load of 98N to a final load of 1274N to thread-wound golf ball 1 of the present invention is preferably 2.6–3.3 mm, more preferably 2.8–3.1 mm. If deformation C is less than 2.6 mm, the shot feeling will become harder. If deformation C is larger than 3.3 mm the resilience performance of thread-wound golf ball 1 will become degraded.

The relationship among deformation A of center 2, deformation B of thread-wound core 6, and deformation C of thread-wound golf ball 1 is preferably A>B>C. In this case, the compression hardness distribution of the entire thread-wound golf ball 1 exhibits a rigid outer circumference with a soft interior. When thread-wound golf ball 1 is hit with a club head of high head speed, the flight distance can be increased since the ball can be shot with low spinning.

The difference (B–C) between deformation B and deformation C is preferably 0–0.3 mm, more preferably 0–0.2 mm. If this difference takes a negative value, the spin rate is increased when hit at a high head speed, resulting in difficulty to increase the flight distance. If this difference exceeds 0.3, the approach spin performance is readily degraded when hit with a short iron.

Center

Center 2 employed in the present invention is fabricated by vulcanization-molding in sphere form by press-molding a rubber composition for the center obtained by mixing, for example, a rubber component, co-crosslinking agent, cross linking initiator, vulcanization regulator, filler, and the like. The vulcanization by press-molding is effected by filling a mold with the above-cited rubber composition for the center, and applying heat at generally 140–180° C. for 10–60 minutes under pressure. The heating process during this vulcanization-molding can be carried in one step or in two steps.

As the rubber component, high cis polybutadiene rubber, for example, is suitable. However, a component with natural rubber, polyisoprene rubber, styrene-butadiene rubber or the like blended with high cis polybutadiene rubber may be employed.

As the aforementioned co-crosslinking agent, metal salt of α, β-unsaturated carboxylic acid, for example, is suitably used. As the α, β-unsaturated carboxylic acid metal salt, sodium salt, zinc salt, or magnesium salt and the like such as of acrylic acid can be used. The blended amount of metal salt of α, β-unsaturated carboxylic acid in the rubber composition of the center is preferably 5–40 parts by mass, further preferably 10–35 parts by mass with respect to 100 parts by mass of the rubber component. If the blended amount of the metal salt of α, β-unsaturated carboxylic acid is lower than 5 parts by mass, center 2 will become so soft that it may not differ from the conventional golf ball in performance. If the blended amount of the metal salt of the α, β-unsaturated carboxylic acid is greater than 40 parts by mass, center 2 will become so hard that the shot feeling of the golf ball may be degraded.

As the crosslinking initiator, organic peroxide such as dicumyl peroxide, 1,1-bis (t-butylperoxy)-3, 3, 5-trimethylcyclohexane, 2, 5-dimethyl-2,5-di (t-butylperoxy) hexane, di-t-butylperoxide or the like may be suitably used. Although the blended amount of this crosslinking initiator is not particularly limited, the amount is preferably 0.5–3 parts by mass with respect to 100 parts by mass of the rubber component.

As the vulcanization regulator, organic sulfur compounds of thiophenols such as penta chloro thiophenol, 4-t-butyl thiophenol, 2-benzamide thiophenol, thio carboxylic acids such as thio benzoic acid, sulfides such as diphenyl monosulfide, diphenyl disulfide, diphenyl polysulfide, morpholine disulfide, dixylyl disulfide, and the like are suitable. The blended amount of this vulcanization regulator is preferably, but not particularly limited to, 0.5–3 parts by mass to 100 parts by mass of the rubber component.

As a filler, zinc oxide, barium sulfate, calcium carbonate and the like are suitable. The blended amount of the filler is preferably, but not particularly limited to, 5–40 parts by mass with respect to 100 parts by mass of the rubber component.

In the present invention, the value of deformation A formed by applying an initial load of 98N to a final load of 1274N to center 2 is preferably 3.3–3.9 mm. If deformation A of center 2 is below 3.3 mm, the shot feeling will become harder. If this value is larger than 3.9 mm, the resilience performance of thread-wound golf ball 1 is not achieved although the shot feeling will becomes softer. A great flight distance cannot be achieved.

The diameter of center 2 is preferably 36.5–38.7 mm. If the diameter of center 2 is smaller than 36.5 mm, the spin rate will become higher and the launch angle will become equal to that of a conventional golf ball. A great flight distance cannot be achieved. If the diameter of center 2 is larger than 38.7 mm, the wound of the rubber thread will be finished before tension is applied on the rubber thread since rubber thread layer 3 must be made thinner taking into account the size of thread-wound golf ball 1. This means that appropriate hardness cannot be applied to thread-wound golf ball 1. Increase in the flight distance cannot be expected.

Thread-Wound Core

In the present invention, deformation B formed by applying an initial load of 98N to a final load of 1274N to thread-wound core 6 is preferably 2.7–3.4 mm, more preferably 2.9–3.2 mm. If deformation B is smaller than 2.7 mm, the shot feeling will become harder. When deformation B exceeds 3.4 mm, sufficient resilience performance of thread-wound golf ball 1 cannot be achieved. The flight distance cannot be readily increased.

The diameter of thread-wound core 6 is preferably 39.2–41.2 mm, more preferably 39.2–40.8 mm, and further preferably 39.6–40.8 mm. If the diameter of thread-wound core 6 is smaller than 39.2 mm, cover 4 will become so thick that the resilience performance of thread-wound golf ball 1 will be degraded. Also, the spin rate when hit will increase to readily gain a higher trajectory, leading to loss in the flight distance. If the diameter of thread-wound core 6 is larger than 41.2 mm, cover 4 will become so thin that the approach spin performance when hit with a short iron will be degraded.

Cover

Cover 4 is formed of a resin composition, surrounding the surface of thread-wound core 6. In the present invention, cover 4 contains thermoplastic polyurethane based elastomer as the main material. Therefore, the shot feeling becomes softer than that of a conventional thread-wound golf ball employing ionomer resin. The scuff resistance is superior. The term "main material" implies that the ratio of the thermoplastic polyurethane based elastomer to the entire basic resin of cover 4, i.e. (mass of thermoplastic polyurethane based elastomer)/(mass of entire basic resin of cover 4), is at least 0.5. The ratio of thermoplastic polyurethane based elastomer is preferably at least 0.7, more preferably at least 0.8.

Thermoplastic polyurethane based elastomer includes a polyurethane structure as a hard segment, and includes polyester or polyether as a soft segment. The polyurethane structure includes, for example, di-isocyanate and an amine type curing agent. As the thermoplastic polyurethane based elastomer employed in the present invention, those including alicyclic di-isocyanate, aromatic di-isocyanate, and aliphatic di-isocyanate for the above-cited di-isocyanate can be used. Particularly, alicyclic di-isocyanate is preferable from the standpoint of yellowing resistance.

As the alicyclic di-isocyanate, $H_{12}$MDI which is hydrogenated 4, 4'-diphenylmethane di-isocyanate (MDI), $H_6$XDI which is hydrogenated xylylene di-isocyanate (XDI), isophorone di-isocyanate (IPDI), trans-1, 4-cyclohexane di-isocyanate (CHDI), and the like are known. From the aspect of versatility, workability, and the like, $H_{12}$MDI is suitable. As specific examples of thermoplastic polyurethane based elastomer with $H_{12}$MDI as the alicyclic di-isocyanate, "Elastollan XNY90A", "Elastollan XNY97A", "Elastollan XNY585" and the like, available from BASF Polyurethane Elastomers Ltd., are known.

As the aromatic di-isocyanate, tolylene di-isocyanate (TDI), 4, 4'-diphenylmethane di-isocyanate (MDI), 1,5-naphthylene di-isocyanate (NDI), xylylene di-isocyanate (XDI), and the like are known. As the aliphatic di-isocyanate, 1,6-hexamethylene di-isocyanate (HDI), and the like are known.

In addition to the thermoplastic polyurethane based elastomer included as the main material for cover 4, at least one type of thermoplastic elastomer such as of, for example, the polyester type, polyamide type, polyolefin type, and the like or ionomer resin can be included. Particularly, inclusion of thermoplastic polyamide based elastomer is preferable from the standpoint of miscibility with thermoplastic polyurethane based elastomer and improving the resilience performance of thread-wound golf ball 1.

In the case where thermoplastic polyamide based elastomer is to be included in cover 4, the mass ratio between thermoplastic polyurethane based elastomer and thermoplastic polyamide based elastomer in cover 4, i.e., (mass of thermoplastic polyurethane based elastomer)+(mass of thermoplastic polyamide based elastomer), is preferably 95/5–70/30. Also, the ratio of the thermoplastic elastomer to the entire basic resin of cover 4, i.e., (mass of thermoplastic polyurethane based elastomer+mass of thermoplastic polyamide based elastomer)/(mass of entire basic resin of cover 4), is preferably at least 0.7, more preferably at least 0.8, and further preferably at least 0.9.

In addition to the above-cited resin component, cover 4 can include a general amount of various well known additives such as a pigment of titanium dioxide, a dispersion, an antioxidant, an ultraviolet absorber, and the like.

Cover 4 has a shore D hardness of 40–55, preferably 40–52, more preferably 42–50, further preferably 42–49, and particularly preferably 42–47. If the shore D hardness of cover 4 is below 40, the spin rate when hit with a driver or long iron will be increased to degrade the flight distance. If the shore D hardness is greater than 55, the shot feeling is degraded and the spin rate when hit with a short iron is reduced, leading to degradation in approach spin performance.

As a method of surrounding the surface of thread-wound core 6 with cover 4, a resin composition for the cover is molded into a half shell of a hemispherical form, two half shells are used to wrap thread-wound core 6, and press-molding is applied for 1–20 minutes at 120–180° C. The thickness of cover 4 formed in such a manner is preferably 0.8–1.8 mm, more preferably 1.0–1.8 mm, and further preferably 1.0–1.6 mm. If the thickness of cover 4 is below 0.8 mm, the approach spin performance will be degraded. If the thickness of cover 4 is greater than 1.8 mm, the resilience performance of thread-wound golf ball 1 will be degraded. A great flight distance cannot be expected.

Also, dimples 5 can be formed at the surface of cover 4, as necessary, during molding of cover 4. Furthermore, cover 4 may be finished with paint and stamped with marking, as necessary, following molding of cover 4.

EXAMPLES

Specific examples of the present invention will be described hereinafter. It will be understood that the present invention is not limited to such examples.

Fabrication of Samples i) Fabrication of Center

The rubber composition for a center based on the blend shown in Table 1 was mixed and kneaded, subjected to heat-pressing for 23 minutes at 160° C. in a mold, resulting in a spheric center. The blended amount of each component in Table 1 is indicated by parts by mass. The diameter of a center obtained in the above-described manner, and deformation A formed by applying an initial load of 98N to a final load of 1274N to the center are shown in Table 3.

TABLE 1

| | Rubber Composition for Center | | | | | | | | |
|---|---|---|---|---|---|---|---|---|---|
| | 1 | 2 | 3 | 4 | 5 | 6 | 7 | 8 | 9 |
| Blend of Center | | | | | | | | | |
| BR-18 (Note 1) | 100 | 100 | 100 | 100 | 100 | 100 | 100 | 100 | 100 |
| Zinc acrylate | 28 | 28 | 28 | 28 | 28 | 28 | 28 | 28 | 28 |
| Zinc oxide | 5 | 5 | 5 | 5 | 5 | 5 | 5 | 5 | 5 |
| Barium sulfate | 17.5 | 17.5 | 21 | 16 | 24 | 17 | 24 | 17.5 | 26 |
| Diphenyl disulfide | 0.5 | 0.5 | 0.5 | 0.5 | 0.5 | 0.5 | 0.5 | 0.5 | 0.5 |
| DCP | 0.9 | 0.9 | 0.9 | 0.9 | 0.9 | 0.9 | 0.9 | 0.9 | 0.9 |
| Vulcanization Molding Condition | 160° C. × 23 minutes | | | | | | | | |

(Note 1) Polybutadiene from JSR Corporation ii) Fabrication of Thread-Wound Core A rubber composition with natural rubber/low cis isoprene rubber blended in 40/60 in mass ratio was vulcanized to obtain a rubber thread of 1.5 mm in width and 0.5 mm in thickness. The obtained rubber thread was wound around the center described above. The diameter of a thread-wound core obtained in such a manner, the thickness of the rubber thread layer, the ratio of the rubber thread layer to the entire golf ball in volume, and deformation B formed by applying an initial load of 98N to a final load of 1274N to the thread-wound core are shown in Table 3.

iii) Fabrication of Resin Composition for Cover

The resin composition for a cover based on the blend shown in Table 2 was mixed using a two-shaft kneading type extruder to obtain the cover resin composition in the form of pellets. A sheet of 2 mm in thickness was fabricated from the obtained pellet resin composition for a cover. This sheet was left for two weeks at 23° C. Then, three or more of the sheets were stacked to have the hardness thereof identified using a spring type Shore D hardness tester defined at ASTM-2240-68. The hardness is shown in Table 3.

TABLE 2

| | Resin Composition for Cover | | | | | | | | |
|---|---|---|---|---|---|---|---|---|---|
| | 1 | 2 | 3 | 4 | 5 | 6 | 7 | 8 | 9 |
| Blend of Cover | | | | | | | | | |
| Elastollan XNY90A (Note 2) | 80 | — | — | — | — | — | — | — | — |
| Elastollan XNY97A (Note 3) | — | 80 | 80 | 80 | 80 | — | — | 80 | — |
| PEBAX5533 (Note 4) | 20 | 20 | 20 | 20 | 20 | — | — | 20 | — |
| Hi-milan 1605 (Note 5) | — | — | — | — | — | — | 50 | — | 50 |
| Hi-milan 1706 (Note 6) | — | — | — | — | — | — | — | — | 50 |
| Hi-milan AM7316 (Note 7) | — | — | — | — | — | — | 50 | — | — |
| Elastollan ET880 (Note 8) | — | — | — | — | — | 100 | — | — | — |
| Titanium Dioxide | 4 | 4 | 4 | 4 | 4 | 4 | 4 | 4 | 4 |

(Note 2) Thermoplastic polyurethane based elastomer of BASF Polyurethane Elastomers Ltd.
Note (3) Thermoplastic polyurethane based elastomer of BASF Polyurethane Elastomers Ltd.
(Note 4) Thermoplastic polyamide based elastomer of Atofina Japan Corp.
(Note 5) Sodium ion neutralized ionomer of Mitsui-Dupont Poly-Chemical Co., Ltd.
(Note 6) Zinc ion neutralized ionomer of Mitsui-Dupont Poly-Chemical Co., Ltd.
(Note 7) Zinc ion neutralized ternary copolymer ionomer of Mitsui-Dupont Poly-Chemical Co., Ltd.
(Note 8) Thermoplastic polyurethane based elastomer of BASF Polyurethane Elastomers Ltd.

(iv) Fabrication of Thread-Wound Golf Ball

The resin composition for a cover shown in Table 2 was subjected to injection-molding to form the half shells of respective covers. Two of the half shells were used to surround the above-described thread-wound core. Press-molding was applied for two minutes at 150° C. using a golf ball mold to wrap the thread-wound core with a cover. Then, the temperature was lowered down to 20° C. by introducing cooling water. Paint was applied on the cover surface, resulting in golf balls having a diameter of 42.75 mm for the Examples of the present invention and Comparative Examples. Deformation C formed by applying an initial load of 98N to a final load of 1274N to the obtained golf ball is shown in Table 3.

Evaluation

Manner of Assessment i) Flight Performance

<Hit Test by Driver>

A metal head club of No. 1 wood (of Sumitomo Rubber Industries, Ltd.: XXIO loft 8°, X shaft) was attached to a swing robot of Golf Laboratory Inc. Each golf ball of the Examples of the present invention and Comparative Examples was hit with the head speed set to 50 m/sec. The launch angle, the back spin rate immediately after being hit, and the total flight distance were measured. Measurements were taken 12 times for each golf ball. The average thereof was taken as the measurement result of the golf ball. The measurement results are shown in Table 3.

<Hit Test By Sand Wedge>

A sand wedge (of Sumitomo Rubber Industries, Ltd., DP-601) was attached to a swing robot of Golf Laboratory Inc. Each golf ball of the Examples of the present invention and Comparative Example was hit with the head speed set to 21 m/sec. The back spin rate immediately after being hit was measured. Measurements were taken 12 times for each golf ball. The average thereof was taken as the measurement result of the golf ball. The measurement results are shown in Table 3.

ii) Scuff Resistance

A commercially-available pitching wedge was attached to a swing robot of Golf Laboratory Inc. Two different sites of each golf ball of the Examples of the present invention and Comparative Example were hit one time each with the head speed set to 36 m/sec. The two hit sites were observed. Assessment was made based on the following criteria. The assessment result are shown in Table 3.

○. . . a flaw on the surface of golf ball, almost unnoticeable

Δ. . . a definite flaw on the surface of the golf ball, slightly napped x . . . the surface of the golf ball considerably scratched with noticeable nape iii) Shot Feeling Each golf ball of the Examples of the present invention and Comparative Example was actually hit by ten golfers to obtain assessment of the shot feeling based on the criteria set forth below. The criterion of the highest count among the criteria was taken as the evaluation result of the shot feeling of the golf ball. The assessment results are shown in Table 3.

○. . . good with repulsion and small impact

Δ. . . normal x . . . great or heavy impact ionomer resin was employed as the main material for the cover. The golf ball of Comparative Example 4 had a small deformation difference (A–B) of 0.3 mm. Therefore, sufficient flight distance could not be obtained when hit with a No. 1 wood club. The shot feeling of the golf ball of Comparative Example 4 was relatively heavy. The golf ball of Comparative Example 5 had a high shore D hardness of 64 for the cover. Therefore, the back spin rate when hit with a sand wedge was small. There was a tendency of degradation in the approach spin performance. The golf ball of Comparative Example 5 had a shot feeling of great impact.

TABLE 3

| | Examples | | | | Comparative Examples | | | | |
|---|---|---|---|---|---|---|---|---|---|
| | 1 | 2 | 3 | 4 | 1 | 2 | 3 | 4 | 5 |
| Golf Ball | | | | | | | | | |
| Center | | | | | | | | | |
| Diameter (mm) | 37.0 | 37.0 | 37.0 | 38.7 | 35.6 | 37.0 | 37.0 | 37.0 | 37.0 |
| Deformation A(mm) | 3.6 | 3.6 | 3.6 | 3.6 | 3.6 | 3.6 | 3.6 | 3.6 | 3.6 |
| Rubber Composition | 1 | 2 | 3 | 4 | 5 | 6 | 7 | 8 | 9 |
| Thread-Wound Core | | | | | | | | | |
| Diameter (mm) | 39.6 | 39.6 | 40.4 | 40.7 | 39.6 | 39.6 | 39.6 | 39.6 | 39.6 |
| Rubber Thread Layer(mm) | 1.3 | 1.3 | 1.7 | 1.0 | 2.0 | 1.3 | 1.3 | 1.3 | 1.7 |
| Rubber Thread Layer Volume (%) | 14.3 | 14.3 | 19.3 | 12.1 | 21.7 | 14.3 | 14.3 | 14.3 | 19.3 |
| Deformation B(mm) | 3.0 | 3.0 | 2.9 | 3.1 | 2.9 | 3.0 | 3.0 | 3.3 | 3.0 |
| Cover | | | | | | | | | |
| Thickness (mm) | 1.6 | 1.6 | 1.2 | 1.0 | 1.6 | 1.6 | 1.6 | 1.6 | 1.2 |
| Hardness (Shore D) | 42 | 47 | 47 | 47 | 47 | 30 | 48 | 47 | 64 |
| Resin Composition | 1 | 2 | 3 | 4 | 5 | 6 | 7 | 8 | 9 |
| Ball | | | | | | | | | |
| Diameter (mm) | 42.75 | 42.75 | 42.75 | 42.75 | 42.75 | 42.75 | 42.75 | 42.75 | 42.75 |
| Deformation C(mm) | 2.9 | 2.9 | 2.8 | 3.0 | 2.8 | 3.0 | 2.9 | 3.2 | 2.8 |
| Deformation (A–B) | 0.6 | 0.6 | 0.7 | 0.5 | 0.7 | 0.6 | 0.6 | 0.3 | 0.6 |
| Deformation (B–C) | 0.1 | 0.1 | 0.1 | 0.1 | 0.1 | 0.0 | 0.1 | 0.1 | 0.2 |
| Performance | | | | | | | | | |
| Flight Performance | | | | | | | | | |
| W#1 50 m/s Launch Angle (°) | 9.5 | 10.0 | 9.8 | 10.3 | 9.0 | 8.5 | 9.4 | 10.1 | 8.3 |
| W#1 50 m/s Back Spin Rate (rpm) | 2850 | 2720 | 2810 | 2600 | 3160 | 3300 | 2910 | 2700 | 2830 |
| W#1 50 m/s Total Flight Distance (m) | 253.5 | 256.2 | 252.9 | 255.0 | 249.5 | 247.0 | 251.5 | 248.3 | 257.0 |
| SW 21m/s Back Spin Rate (rpm) | 7060 | 6850 | 6940 | 6790 | 6920 | 7210 | 6700 | 6770 | 5680 |
| Scuff Resistance | ○ | ○ | ○ | ○ | ○ | ○ | X | ○ | Δ |
| Shot Feeling | ○ | ○ | ○ | ○ | ○ | ○ | ○ | Δ | X |

(Assessment Result)

The golf balls of Examples 1–4 were superior to golf balls of Comparative Examples 1–5 in the total flight distance when hit with a No. 1 wood club as well as in the back spin rate when hit with a sand wedge. Furthermore, the golf balls of Examples 1–4 were all superior in scuff resistance and shot feeling.

Since the golf ball of Comparative Example 1 had a high volume ratio of 21.7% for the rubber thread layer, sufficient flight distance could not be achieved when hit with a No. 1 wood club. The golf ball of Comparative Example 2 had a low shore D hardness of 30 for the cover. Therefore, sufficient flight distance could not be achieved when hit with a No. 1 wood club. The golf ball of Comparative Example 3 had a tendency of degradation in scuff resistance since By the above-described invention, a golf ball of favorable shot feeling and approach spin performance, exhibiting a great flight distance, and superior in scuff resistance can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thread-wound golf ball having a cover wrapped around a rubber thread layer formed by winding a rubber thread around a center, wherein a ratio of volume of said rubber thread layer to the volume of said thread-wound golf ball is 10–20%, when deformation formed by applying an initial load of 98N to a final load of 1274N to said center is A, and deformation formed by applying an initial load of 98N to a final load of 1274N to a thread-wound core having a rubber thread wound around said center is B, a difference therebetween (A–B) is 0.5–0.7 mm, said cover including thermoplastic polyurethane based elastomer as a main material, and said cover having a shore D hardness of 40–55.

2. The thread-wound golf ball according to claim 1, wherein said cover has a thickness of 0.8–1.8 mm, said deformation A formed by applying an initial load of 98N to a final load of 1274N to said center is 3.3–3.9 mm, and said deformation B formed by applying an initial load of 98N to a final load of 1274N to said thread-wound core is 2.7–3.4 mm.

3. The thread-wound golf ball according to claim 1, wherein di-isocyanate constituting the thermoplastic polyurethane based elastomer included as the main material in said cover is alicyclic di-isocyanate.

4. The thread-wound golf ball according to claim 1, wherein the ratio of volume of said rubber thread layer to the volume of said thread-wound golf ball is 12.0–19.5%.

5. The thread-wound golf ball according to claim 1, wherein the ratio of volume of said rubber thread layer to the volume of said thread-wound golf ball is 12.0–15.0%.

6. The thread-wound golf ball according to claim 2, wherein the cover has a thickness of 1.0–1.6 mm.

7. The thread-wound golf ball according to claim 2, wherein said deformation B formed by applying an initial load of 98N to a final load of 1274N to said thread-wound core is 2.9–3.2 mm.

8. The thread-wound golf ball according to claim 1, wherein the cover has a shore D hardness of 42–50.

9. The thread-wound golf ball according to claim 1, wherein the cover has a shore D hardness of 42–47.

* * * * *